US006811812B2

(12) United States Patent
Van Steenkiste

(10) Patent No.: US 6,811,812 B2
(45) Date of Patent: Nov. 2, 2004

(54) LOW PRESSURE POWDER INJECTION METHOD AND SYSTEM FOR A KINETIC SPRAY PROCESS

(75) Inventor: Thomas Hubert Van Steenkiste, Ray, MI (US)

(73) Assignee: Delphi Technologies, Inc., Troy, MI (US)

( * ) Notice: Subject to any disclaimer, the term of this patent is extended or adjusted under 35 U.S.C. 154(b) by 75 days.

(21) Appl. No.: 10/117,385

(22) Filed: Apr. 5, 2002

(65) Prior Publication Data

US 2003/0190414 A1 Oct. 9, 2003

(51) Int. Cl.[7] ..... B05D 1/06
(52) U.S. Cl. ..... 427/189; 427/446; 427/422
(58) Field of Search ..... 427/189, 192, 427/191, 195, 422, 446; 239/79, 85, 427, 434.5; 417/197; 118/308

(56) References Cited

U.S. PATENT DOCUMENTS

| | | | | |
|---|---|---|---|---|
| 2,861,900 A | | 11/1958 | Smith et al. | |
| 3,100,724 A | | 8/1963 | Rocheville | |
| 3,993,411 A | | 11/1976 | Babcock et al. | |
| 4,263,335 A | | 4/1981 | Wagner et al. | |
| 4,416,421 A | | 11/1983 | Browning et al. | |
| 4,606,495 A | | 8/1986 | Stewart, Jr. et al. | |
| 4,891,275 A | | 1/1990 | Knoll | |
| 4,939,022 A | | 7/1990 | Palanisamy | |
| 5,187,021 A | | 2/1993 | Vydra et al. | |
| 5,217,746 A | * | 6/1993 | Lenling et al. | 427/450 |
| 5,271,965 A | | 12/1993 | Browning | |
| 5,302,414 A | * | 4/1994 | Alkhimov et al. | 427/192 |
| 5,340,015 A | | 8/1994 | Hira et al. | |
| 5,362,523 A | * | 11/1994 | Gorynin et al. | 427/446 |
| 5,395,679 A | | 3/1995 | Myers et al. | |
| 5,424,101 A | | 6/1995 | Atkins et al. | |
| 5,464,146 A | | 11/1995 | Zaluzec et al. | |
| 5,476,725 A | | 12/1995 | Papich et al. | |

(List continued on next page.)

FOREIGN PATENT DOCUMENTS

| | | | |
|---|---|---|---|
| DE | 42 36 911 | | 12/1993 |
| DE | 199 59 515 | | 6/2001 |
| DE | 100 37 212 | | 1/2002 |
| DE | 101 26 100 | | 12/2002 |
| EP | 1 160 348 | | 12/2001 |
| WO | 98/22639 | * | 5/1998 |
| WO | 02/052064 | | 1/2002 |

OTHER PUBLICATIONS

Van Steenkiste, et al; *Kinetic Spray Coatings*; in Surface & Coatings Technology III; 1999; pp. 62–71, no month date.

(List continued on next page.)

*Primary Examiner*—Katherine A. Bareford
(74) *Attorney, Agent, or Firm*—Scott A. McBain

(57) ABSTRACT

Disclosed is a method and a nozzle for a kinetic spray system that uses much lower powder pressures than previously used in kinetic spray systems. The method permits one to significantly decrease the cost of the powder delivery portion of the system, to run the system at higher temperatures for increased deposition efficiency and to eliminate clogging of the nozzle. The nozzle is a supersonic nozzle having a throat located between a converging region and a diverging region, with the diverging region defined between the throat and an exit end. At least one injector is positioned between the throat and the exit end with the injector in direct communication with the diverging region. The powder particles to be sprayed are injected through the at least one injector and entrained in a gas flowing through the nozzle. The entrained particles are accelerated to a velocity sufficient to cause them to adhere to a substrate positioned opposite the nozzle.

22 Claims, 2 Drawing Sheets

U.S. PATENT DOCUMENTS

| | | | | |
|---|---|---|---|---|
| 5,527,627 | A | | 6/1996 | Lautzenhiser et al. |
| 5,593,740 | A | | 1/1997 | Strumbon et al. |
| 5,795,626 | A | | 8/1998 | Gabel et al. |
| 5,854,966 | A | | 12/1998 | Kampe et al. |
| 5,894,054 | A | | 4/1999 | Paruchuri et al. |
| 5,907,761 | A | | 5/1999 | Tohma et al. |
| 5,952,056 | A | | 9/1999 | Jordan et al. |
| 5,989,310 | A | | 11/1999 | Chu et al. |
| 6,033,622 | A | | 3/2000 | Maruyama |
| 6,051,045 | A | | 4/2000 | Narula et al. |
| 6,051,277 | A | | 4/2000 | Claussen et al. |
| 6,074,737 | A | | 6/2000 | Jordan et al. |
| 6,129,948 | A | | 10/2000 | Plummet et al. |
| 6,139,913 | A | * | 10/2000 | Van Steenkiste et al. ... 427/191 |
| 6,283,386 | B1 | | 9/2001 | Van Steenkiste et al. ... 439/427 |
| 6,402,050 | B1 | * | 6/2002 | Kashirin et al. ..... 239/79 |
| 6,623,796 | B1 | | 9/2003 | Van Steenkiste ..... 427/189 |
| 2002/0071906 | A1 | * | 6/2002 | Rusch ..... 427/180 |
| 2002/0102360 | A1 | | 8/2002 | Subramanian et al. |

OTHER PUBLICATIONS

Liu, et al; *Recent Development in the Fabrication of Metal Matrix–Particulate Composities Using Powder Metallurgy Techniques*; in Journal of Material Science 29; 1994; pp. 1999–2007; National University of Singapore, Japan, no month date.

Papyrin; *The Cold Gas–Dynamic Spraying Method a New Method for Coatings Deposition Promises a New Generation of Technologies; Novosibirsk, Russia*, no date.

McCune, al; Characterization of Copper and Steel Coatings Made by the Cold Gas–Dynamic Spray Method; National Thermal Spray Conference, no date.

Alkhimov, et al; *A Method of "cold" Gas–Dynamic Deposition; Sov. Phys. Kokl. 36(12; Dec. 1990; pp.1047–1049.*

Dykuizen, et al; *Impact of High Velocity Cold Spray Particles*; in Journal of Thermal Spray Technology 8(4); 1999; pp. 559–564, no month date.

Swartz, et al; *Thermal Resistance At Interface; Appl. Phys. Lett.*, vol. 51, No. 26, 28; Dec. 1987; pp. 2201–2202.

Davis, et al; *Thermal Conductivity of Metal–Matrix Composlites; J.Appl. Phys. 77 (10), May 15, 1995*; pp. 4494–4960.

Stoner et al; *Measurements of the Kapitza Conductance between Diamond and Several Metals*; Physical Review Letters, vol. 68, No. 10; Mar. 9, 1992; pp. 1563–1566.

Stoner et al; *Kapitza conductance and heat flow between solids at temperatures from 50 to 300K*; Physical Review B, vol. 48, No. 22, Dec. 1, 1993–II; pp. 16374–16387.

Johnson et al; *Diamond/Al metal matrix composites formed by the pressureless metal infiltration process*; J. Mater, Res., vol. 8, No. 5, May 1993; pp. 11691173.

Rajan et al; *Reinforement coatings and interfaces in Aluminium Metal Matrix Composites*; pp. 3491–3503., 1998, no month date.

*LEC Manufacturing and Engineering Capabilities*; Lanxide Electronic Components, Inc., no date.

Dykhuizen et al; *Gas Dynamic Principles of Cold Spray*; Journal of Thermal Spray Technology; 06–98; pp. 205–212, Jun. 1998.

McCune et al; *An Exploration of the Cold Gas–Dynamic Spray Method For Several Materials Systems*; , no date.

Ibrahim et al; *Particulte Reinforced Metal Matrix Composites—A Review; Journal of Materials Science 26; pp. 1137–1156.*, 1991.

European Search Report dated Jan. 29, 2004 and it's Annex.

* cited by examiner

LOW PRESSURE POWDER INJECTION METHOD AND SYSTEM FOR A KINETIC SPRAY PROCESS

INCORPORATION BY REFERENCE

U.S. Pat. No. 6,139,913, "Kinetic Spray Coating Method and Apparatus," and U.S. Pat. No. 6,283,386 "Kinetic Spray Coating Apparatus" are incorporated by reference herein.

TECHNICAL FIELD

The present invention is directed to a method and nozzle for producing a coating using a kinetic spray system with much lower powder pressures than previously used. The invention permits one to significantly decrease the cost of the powder delivery system, to run the system at higher temperatures for increased deposition efficiency and to eliminate clogging of the nozzle.

BACKGROUND OF THE INVENTION

A new technique for producing coatings on a wide variety of substrate surfaces by kinetic spray, or cold gas dynamic spray, was recently reported in an article by T. H. Van Steenkiste et al., entitled "Kinetic Spray Coatings," published in Surface and Coatings Technology, vol. 111, pages 62–71, Jan. 10, 1999. The article discusses producing continuous layer coatings having low porosity, high adhesion, low oxide content and low thermal stress. The article describes coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and increases its velocity. The velocity varies approximately as the square root of the inlet air temperature. The actual mechanism of bonding of the particles to the substrate surface is not fully known at this time. It is believed that the particles must exceed a critical velocity prior to their being able to bond to the substrate. The critical velocity is dependent on the material of the particle. It is believed that the initial particles to adhere to a metal or alloy substrate have broken the oxide shell on the substrate material permitting subsequent metal to metal bond formation between plastically deformed particles and the substrate. Once an initial layer of particles has been formed on a substrate the subsequent particles both bind to the voids between previously bound particles and also engage in particle to particle bonds. The bonding process is not due to melting of the particles in the air stream because the temperature of the air stream and the time of exposure to the heated air are selected to ensure that the temperature of the particles is always below their melting temperature.

That work had improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste article reported on work conducted by the National Center for Manufacturing Sciences (NCMS) to improve on the earlier Alkimov process and apparatus. Van Steenkiste et al. demonstrated that Alkimov's apparatus and process could be modified to produce kinetic spray coatings using particle sizes of greater than 50 microns and up to about 106 microns.

The modified process and apparatus for producing such larger particle size kinetic spray continuous layer coatings are disclosed in U.S. Pat. Nos. 6,139,913, and 6,283,386. The process and apparatus provide for heating a high pressure air flow up to about 650° C. and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to impinge the particles to the surface of the substrate. The temperatures and pressures used are lower than that necessary to cause particle melting or thermal softening of the selected particle. Therefore, no phase transition occurs in the particles prior to impingement. It has been found that each type of particle material has a threshold critical velocity that must be exceeded before the material begins to adhere to the substrate. The disclosed method did not disclose the use of particles in excess of 106 microns.

There are several difficulties associated with current kinetic spray systems. First, the powder is injected into the heated main gas stream prior to passage through the de Laval nozzle. Because the heated main gas stream is under high pressure injection of the powder requires high pressure powder delivery systems, which are quite expensive. Second, the powder particles and heated main gas both must pass through the throat of the nozzle and the particles frequently plug a portion of the diverging section and the nozzle throat, which requires a complete shutdown of the system and cleaning of the nozzle. Finally, for a given material the main gas temperature must be sufficiently low that it does not result in melting of the particles and significant plugging of the nozzle, which may not be an ideal temperature for efficient deposition.

SUMMARY OF THE INVENTION

In one embodiment the present invention is a method of kinetic spray coating a substrate comprising the steps of: providing particles of a material to be sprayed; providing a supersonic nozzle having a throat located between a converging region and a diverging region; directing a flow of a gas through the nozzle, the gas having a temperature insufficient to cause melting of the particles in the nozzle; and injecting the particles directly into the diverging region of the nozzle at a point after the throat, entraining the particles in the flow of the gas and accelerating the particles to a velocity sufficient to result in adherence of the particles on a substrate positioned opposite the nozzle.

In another embodiment the present invention is a supersonic nozzle for a kinetic spray system comprising: a throat located between a converging region and a diverging region, the diverging region defined between the throat and an exit end; and at least one injector positioned between the throat and the exit end, the injector in direct communication with the diverging region.

In yet another embodiment the present invention is a kinetic spray system comprising: a supersonic nozzle comprising a throat located between a converging region and a diverging region, the diverging region defined between the throat and an exit end; at least one injector positioned between the throat and the exit end, the injector in direct communication with the diverging region; a low pressure powder feeder connected to the at least one injector; and a high pressure source of a heated main gas connected to the nozzle.

DESCRIPTION OF THE PREFERRED EMBODIMENT

The present invention comprises an improvement to the kinetic spray process as generally described in U.S. Pat. Nos. 6,139,913, 6,283,386 and the article by Van Steenkiste, et al. entitled "Kinetic Spray Coatings" published in Surface and Coatings Technology Volume III, Pages 62–72, Jan. 10, 1999, all of which are herein incorporated by reference.

Figure 1:
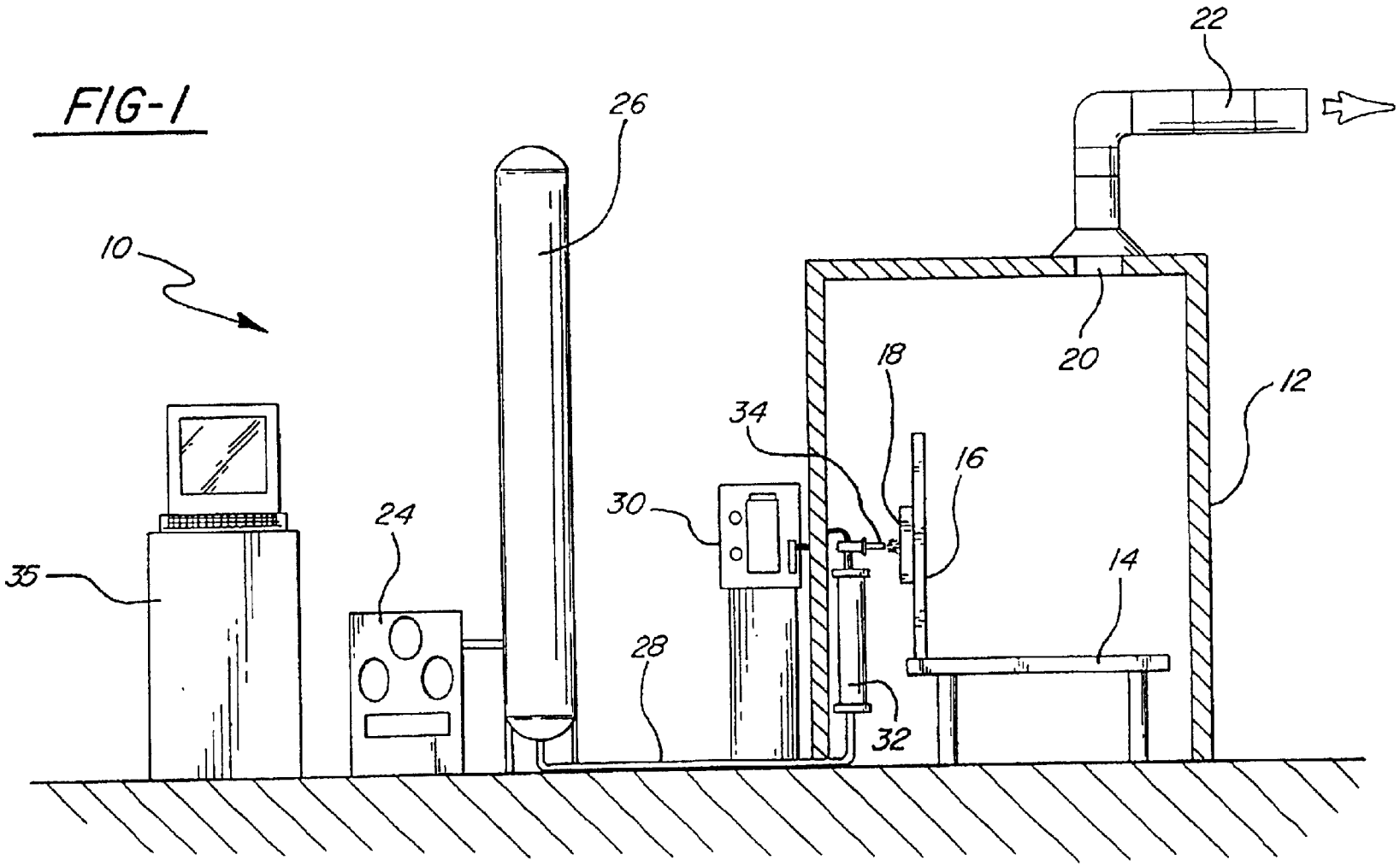
FIG. 1 is a generally schematic layout illustrating a kinetic spray system for performing the method of the present invention.

Referring first to FIG. 1, a kinetic spray system according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable workpiece formed of a substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an air compressor 24 capable of supplying air pressure up to 3.4 MPa (500 psi) to a high pressure air ballast tank 26. The air ballast tank 26 is connected through a line 28 to both a low pressure powder feeder 30 and a separate air heater 32. The air heater 32 supplies high pressure heated air, the main gas described below, to a kinetic spray nozzle 34. The pressure of the main gas generally is set at from 150 to 500 psi. The low pressure powder feeder 30 mixes particles of a spray powder and supplies the mixture of particles to the nozzle 34. A computer control 35 operates to control both the pressure of air supplied to the air heater 32 and the temperature of the heated main gas exiting the air heater 32.

Figure 2:
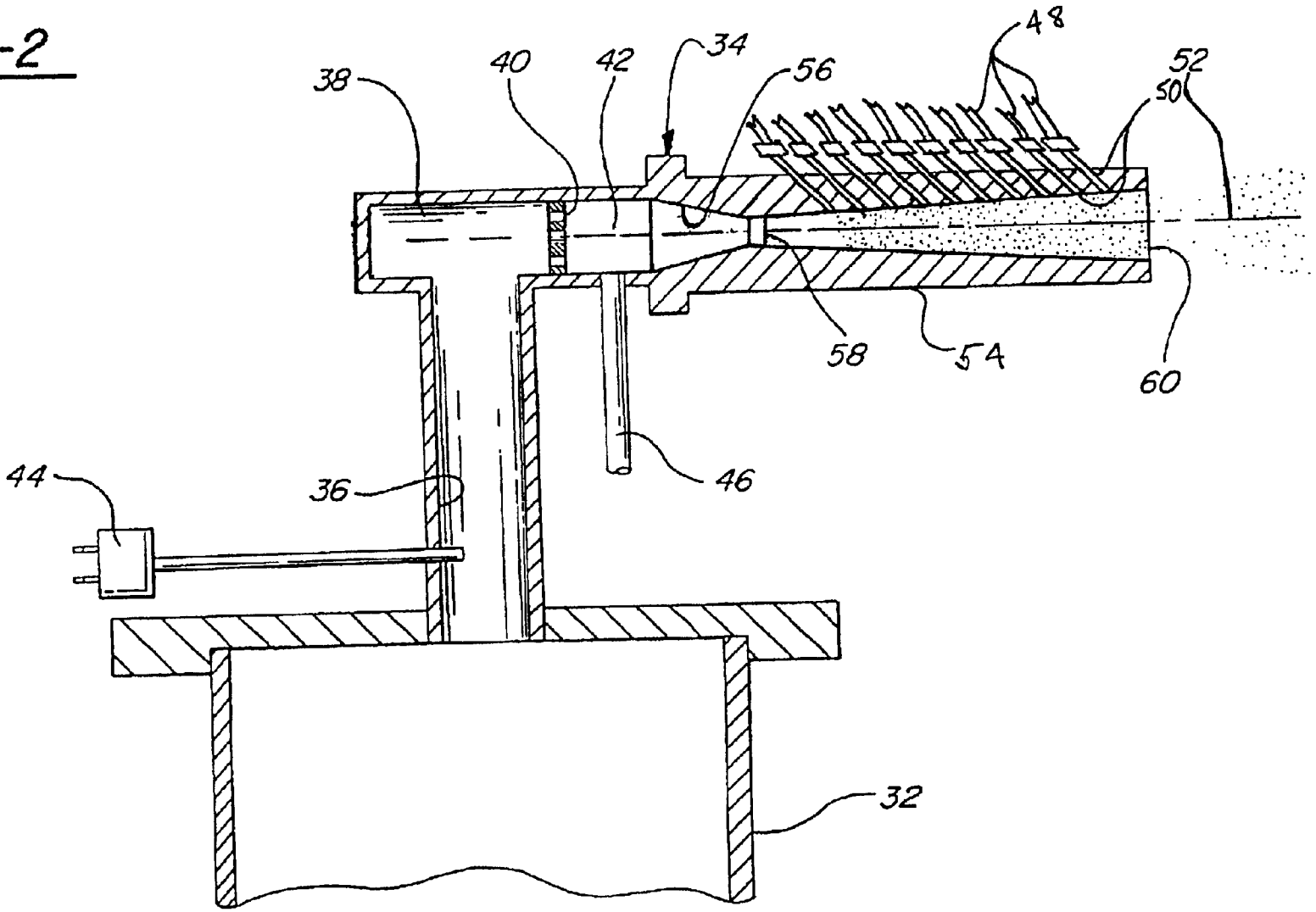
FIG. 2 is an enlarged cross-sectional view of a kinetic spray nozzle used in the system.

FIG. 2 is a cross-sectional view of the nozzle 34 and its connections to the air heater 32 and the powder feeder 30. A main air passage 36 connects the air heater 32 to the nozzle 34. Passage 36 connects with a premix chamber 38 that directs air through a flow straightener 40 and into a chamber 42. Temperature and pressure of the air or other heated main gas are monitored by a gas inlet temperature thermocouple 44 in the passage 36 and a pressure sensor 46 connected to the chamber 42. The main gas has a temperature that is always insufficient to cause melting in the nozzle 34 of any particles being sprayed. The main gas temperature generally ranges from 200 to 3000° F. The main gas temperature can be well above the melt temperature of the particles. Main gas temperatures that are 5 to 7 fold above the melt temperature of the particles have been used in the present system 10. What is necessary is that the temperature and exposure time to the main gas be selected such that the particles do not melt in the nozzle 34. The temperature of the gas rapidly falls as it travels through the nozzle 34. In fact, the temperature of the gas measured as it exits the nozzle 34 is often at or below room temperature even when its initial temperature is above 1000° F.

Chamber 42 is in communication with a de Laval type supersonic nozzle 54. The nozzle 54 has a central axis 52 and an entrance cone 56 that decreases in diameter to a throat 58. The entrance cone 56 forms a converging region of the nozzle 54. Downstream of the throat 58 is an exit end 60 and a diverging region is defined between the throat 58 and the exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The diverging region of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters.

The de Laval nozzle 54 is modified from previous systems in the diverging region. In the present invention a mixture of unheated low pressure air and coating powder is fed from the powder feeder 30 through one of a plurality of supplemental inlet lines 48 each of which is connected to a powder injector tube 50 comprising a tube having a predetermined inner diameter. For simplicity the actual connections between the powder feeder 30 and the inlet lines 48 are not shown. The injector tubes 50 supply the particles to the nozzle 54 in the diverging region downstream from the throat 58, which is a region of reduced pressure. The length of the nozzle 54 from the throat 58 to the exit end can vary widely and typically ranges from 100 to 400 millimeters.

As would be understood by one of ordinary skill in the art the number of injector tubes 50, the angle of their entry relative to the central axis 52 and their position downstream from the throat 58 can vary depending on any of a number of parameters. In FIG. 2 ten injector tubes 50 are show, but the number can be as low as one and as high as the available room of the diverging region. The angle relative to the central axis 52 can be any that ensures that the particles are directed toward the exit end 60, basically from 1 to about 90 degrees. It has been found that an angle of 45 degrees relative to central axis 52 works well. An inner diameter of the injector tube 50 can vary between 0.4 to 3.0 millimeters. The use of multiple injector tubes 50 permits one to easily modify the system 10. One can rapidly change particles by turning off a first powder feeder 30 connected to a first injector tube 50 and the turning on a second powder feeder 30 connected to a second injector tube 50. Such a rapid change over is not easily accomplished with prior systems. For simplicity only one powder feeder 30 is shown in FIG. 1, however, as would be understood by one of ordinary skill in the art, the system 10 could include a plurality of powder feeders 30. The system also permits one to mix a number of powders in a single injection cycle by having a plurality of powder feeders 30 and injector tubes 50 functioning simultaneously. An operator can also run a plurality of particle populations, each having a different average nominal diameter, with the larger population being injected closer to the throat 58 relative to the smaller size particle populations and still get efficient deposition. The present system 10 will permit an operator to better optimize the deposition efficiency of a particle or mixture of particles. For example, it is known that harder materials have a higher critical velocity, therefore in a mixture of particles the harder particles could be introduced at a point closer to the throat 58 thereby giving a longer acceleration time.

Using a nozzle 54 having a length of 300 millimeters from throat 58 to exit end 60, a throat of 2 millimeters and an exit end 60 with a rectangular opening of 5 by 12.5 millimeters the pressure drops quickly as one goes downstream from the throat 58. The measured pressures were: 14.5 psi at 1 inch after the throat 58; 20 psi at 2 inches from the throat 58; 12.8 psi at 3 inches from the throat 58; 9.25 psi at 4 inches from the throat 58; 10 psi at 5 inches from the throat 58 and below atmospheric pressure beyond 6 inches from the throat 58. These results show that one can use much lower pressures to inject the powder when the injection takes place after the throat 58. The low pressure powder feeder 30 of the present invention has a cost that is approximately ten-fold lower than the high pressure powder feeders that have been used in past systems. Generally, the low pressure powder feeder 30 is used at a pressure of 100 psi or less. All that is required is that it exceed the main gas pressure at the point of injection.

The nozzle 54 produces an exit velocity of the entrained particles of from 300 meters per second to as high as 1200 meters per second. The entrained particles gain kinetic and thermal energy during their flow through this nozzle 54. It will be recognized by those of skill in the art that the temperature of the particles in the gas stream will vary depending on the particle size and the main gas temperature. The main gas temperature is defined as the temperature of heated high-pressure gas at the inlet to the nozzle 54. Since these temperatures are chosen so that they heat the particles to a temperature that is less than the melting temperature of the particles, even upon impact, there is no change in the solid phase of the original particles due to transfer of kinetic and thermal energy, and therefore no change in their original physical properties. The particles themselves are always at a temperature below their melt temperature. The particles exiting the nozzle 54 are directed toward a surface of a substrate to coat it.

Upon striking a substrate opposite the nozzle 54 the particles flatten into a nub-like structure with an aspect ratio of generally about 5 to 1. When the substrate is a metal and the particles are a metal the particles striking the substrate surface fracture the oxidation on the surface layer and subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate it is necessary that it reach or exceed its critical velocity which is defined as the velocity where at it will adhere to a substrate when it strikes the substrate after exiting the nozzle 54. This critical velocity is dependent on the material composition of the particle. In general, harder materials must achieve a higher critical velocity before they adhere to a given substrate. It is not known at this time exactly what is the nature of the particle to substrate bond; however, it is believed that a portion of the bond is due to the particles plastically deforming upon striking the substrate.

As disclosed in U.S. Pat. No. 6,139,913 the substrate material useful in the present invention may be comprised of any of a wide variety of materials including a metal, an alloy, a semi-conductor, a ceramic, a plastic, and mixtures of these materials. All of these substrates can be coated by the process of the present invention. The particles used in the present invention may comprise any of the materials disclosed in U.S. Pat. Nos. 6,139,913 and 6,283,386 in addition to other know particles. These particles generally comprise metals, alloys, ceramics, polymers, diamonds and mixtures of these. The particles may have an average nominal diameter of from 1 to 110 microns. Preferably the particles have an average nominal diameter of from 50 to 90 microns.

EXAMPLES

In a first example a system and nozzle designed according to U.S. Pat. No. 6,139,913 was used to spray tin particles having an average nominal diameter of 60 to 90 microns onto a substrate. The substrate was not sandblasted prior to attempts to coat it. The nozzle had a length of 80 millimeters from throat to exit end, a throat of 2.8 millimeters, and an injector tube that injected the particles under a high pressure of approximately 300 to 350 psi into the chamber. The maximal main gas temperature that could be used without clogging of the nozzle in that system was 300° F.

In a second series of examples a system 10 designed according to the present invention was used. The nozzle 54 had a length from throat 58 to exit end of 300 mm with a rectangular exit of 5 by 12.5 millimeters and a throat 58 of 2.8 millimeters. A total of eleven injector tubes 50 were positioned into the nozzle 54 after the throat 58. The injector tubes 50 were spaced apart by one inch and set at an angle of 45 degrees with respect to the central axis 52. Using this nozzle 54 tin particles of 60 to 90 microns could be sprayed at a main gas temperature of up to 1000° F. without clogging of the nozzle 54. In separate experiments the tin particles were sprayed through injector tubes 50 at one, seven and eight inches downstream from the throat 58. The injection pressures ranged from just over positive pressure at both seven and eight inches from the throat to 20 psi at one inch from the throat 58. Thus, using the nozzle 54 of the present invention a powder can be sprayed at over a three-fold higher temperature and a sixteen-fold lower pressure compared to prior kinetic spray systems.

While the preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A method of kinetic spray coating a substrate comprising the steps of:

a) providing particles of a material to be sprayed;

b) providing a supersonic nozzle having a throat located between a converging region and a diverging region;

c) directing a flow of a main gas through the nozzle, the main gas having a temperature insufficient to cause melting of the particles in the nozzle; and d) injecting the particles using a positive pressure that is greater than a main gas pressure at the point of injection directly into the diverging region of the nozzle at a point after the throat and before the main gas pressure is below atmospheric pressure, entraining the particles in the flow of the main gas and accelerating the particles to a velocity sufficient to result in adherence of the particles on a substrate positioned opposite the nozzle.

2. The method of claim 1, wherein step a) further comprises providing a mixture of particles comprising a plurality of different materials and step d) comprises injecting the mixture of particles directly into the diverging region of the nozzle.

3. The method of claim 2, wherein step a) further comprises providing a mixture of particles each having a nominal diameter ranging from 1 to 110 microns.

4. The method of claim 1, wherein step a) further comprises providing a mixture of at least a first particle population having a first average nominal diameter and a second particle population having a second average nominal diameter, the first average nominal diameter being smaller than the second average nominal diameter; and step d) comprises injecting the mixture directly into the diverging region of the nozzle.

5. The method of claim 4, wherein step a) comprises selecting the first average nominal diameter and the second average nominal diameter to range from 1 to 110 microns.

6. The method of claim 1, wherein step a) further comprises providing at least a first particle population having a first average nominal diameter and a second particle population having a second average nominal diameter, the first average nominal diameter being smaller than the second average nominal diameter; and step d) further comprises injecting the first particle population directly into a first location in the diverging region and injecting the second particle population directly into a second location in the diverging region, the first location spaced apart from the second location.

7. The method of claim 6, wherein step d) further comprises selecting the second location to be closer to the throat than the first location.

8. The method of claim 6, wherein step d) further comprises selecting the first location to be closer to the throat than the second location.

9. The method of claim 1, wherein step a) further comprises providing at least a first particle population having a first yield stress and a second particle population having a second yield stress different from the first yield stress; and step d) further comprises injecting the first particle population directly into a first location in the diverging region and injecting the second particle population directly into a second location in the diverging region, the first location spaced apart from the second location.

10. The method of claim 9, wherein the first yield stress is selected to be less than the second yield stress and step d) further comprises selecting the second location to be closer to the throat than the first location.

11. The method of claim 9, wherein the first yield stress is selected to be less than the second yield stress and step d) further comprises selecting the first location to be closer to the throat than the second location.

12. The method of claim 1, wherein step a) further comprises providing particles each having a nominal diameter of from 1 to 110 microns.

13. The method of claim 1, wherein step a) further comprises providing particles comprising at least one of a metal, an alloy, a polymer, a ceramic, a diamond, or mixtures thereof.

14. The method of claim 1, wherein step b) further comprises providing a nozzle having a throat with a diameter ranging from 1.5 to 3.0 millimeters.

15. The method of claim 1, wherein step b) further comprises providing a nozzle having a throat with a diameter ranging from 2.0 to 3.0 millimeters.

16. The method of claim 1, wherein step c) further comprises providing a gas having a temperature ranging from 300 to 3000° F.

17. The method of claim 1, wherein step c) further comprises providing a gas having a pressure prior to flowing through the nozzle ranging from 150 to 500 pounds per square inch.

18. The method of claim 1, wherein step d) further comprises injecting the particles into the nozzle at an angle, relative to a central axis of the nozzle, ranging from 1 to 90 degrees.

19. The method of claim 1, wherein step d) further comprises injecting the particles through an injector having an inner diameter ranging from 0.40 to 3.00 millimeters directly into the diverging region.

20. The method of claim 1, wherein step d) further comprises injecting the particles directly into the diverging region at a positive pressure of less than or equal to 100 pounds per square inch.

21. The method of claim 1, wherein step d) further comprises accelerating the particles to a velocity ranging from 300 to 1200 meters per second.

22. The method of claim 1, wherein step d) further comprises providing a substrate comprising one of a metal, an alloy, a plastic, a polymer, a ceramic, or a mixture thereof opposite the nozzle.

* * * * *